United States Patent [19]

Ruger et al.

[11] Patent Number: 4,719,854

[45] Date of Patent: Jan. 19, 1988

[54] RESILIENT SHEET GRIPPER FOR A SHEET-FED ROTARY PRINTING PRESS

[75] Inventors: Manfred Ruger, Heusenstamm; Valentin Gensheimer, Muhlheim am Main; Hanns-Otto Haas, Heusenstamm, all of Fed. Rep. of Germany

[73] Assignee: M.A.N.-Roland Druckmaschinen Aktiengesellschaft, Fed. Rep. of Germany

[21] Appl. No.: 892,149

[22] Filed: Jul. 31, 1986

[30] Foreign Application Priority Data

Aug. 19, 1985 [DE] Fed. Rep. of Germany ..... 3529612

[51] Int. Cl.[4] ..... B41J 1/60

[52] U.S. Cl. ..... 101/409; 101/415.1

[58] Field of Search ..... 101/408–409, 101/415.1

[56] References Cited

U.S. PATENT DOCUMENTS

| | | | |
|---|---|---|---|
| 2,378,478 | 6/1945 | Harless | 101/409 |
| 2,906,204 | 9/1959 | Luehrs | 101/409 |
| 2,935,937 | 5/1960 | Rossetto et al. | 101/409 |
| 3,044,771 | 7/1962 | Norton | 101/409 X |
| 3,536,321 | 10/1970 | Straube | 101/409 X |
| 3,650,211 | 3/1972 | Nentwich | 101/409 |
| 4,647,031 | 3/1987 | Smith et al. | 101/409 |

FOREIGN PATENT DOCUMENTS

| | | |
|---|---|---|
| 2030040 | 1/1976 | Fed. Rep. of Germany . |
| 3130689 | 7/1982 | Fed. Rep. of Germany . |
| 67992 | 7/1969 | U.S.S.R. . |

*Primary Examiner*—E. H. Eickholt

*Attorney, Agent, or Firm*—Leydig, Voit & Mayer

[57] ABSTRACT

A resilient sheet gripper for a sheet-fed rotary printing press having a gripper finger resiliently connected to a clamping member secured to a gripper shaft is provided including prestressed spring strips for connecting the gripper finger to the clamping member with each spring strip having articulation points disposed along a line passing substantially through the axis of the gripper shaft.

5 Claims, 3 Drawing Figures

RESILIENT SHEET GRIPPER FOR A SHEET-FED ROTARY PRINTING PRESS

FIELD OF THE INVENTION

The present invention relates generally to a sheet gripper for a sheet-fed rotary printing press and more particularly concerns such a gripper having a resilient gripper finger.

BACKGROUND OF THE INVENTION

Resilient sheet grippers are widely used in printing presses to non-positively grip a sheet of paper and hold it up against a cylinder. If the paper is pulled out of the gripper even slightly, problems arise with mackling and registration errors occur. Therefore, the gripper typically is required to have a very considerable retaining force, which usually means that the gripper springs must have a very high spring constant. Also, since any play present at the gripper tip would result in registration errors and mackling, it is desirable to minimize the bearing clearances of the gripper elements. The reduced bearing clearance, however, leads to increased friction in the gripper bearings so that some of the spring force operative for gripping is consumed in the bearing itself. The need further arises for the gripper shaft bearings to be very stable in order to reduce deformation associated with the abrupt closure of the grippers. A disadvantage of this is that very high mass forces are produced.

In short, the known gripper systems require very considerable forces for their actuation and only some of such forces can be used for sheet retention. Such substantial and abrupt forces may also cause unwanted oscillations of the press.

A gripper system of this general kind is shown in DD-PS No. 66 634 wherein a one-piece gripper lever is supported on a gripper shaft and adjustable biasing is provided by two compression springs. A disadvantage of this known system is that the gripper lever loses its statically determined position when the fullest possible compensation for the bearing force is required. At very high press speeds and high biasing forces, centering becomes inadequate, for example, as a result of disturbing vibrations introduced into the press. Other disadvantages are the relatively large inertia radius and the mass of the swinging parts.

Another known gripper system is disclosed in DE-OS No. 1 908 181 wherein the spindle of the gripper finger pivot is pivotally disposed parallel to the gripper shaft, the spindle of the gripper finger pivot being disposed substantially on the prolongation of a straight line connecting the support surface for the gripper tip to the gripper shaft axis. As is apparent from the geometry shown therein in FIG. 1, the force which the gripper tip applies to the gripper support also has a component in the direction of sheet movement. The sheet may therefore move for this reason and because of possible twisting of the gripper shaft at high biasings, even though there may be some improvement as compared with conventional grippers in which there is an arcuate motion around the gripper shaft axis.

The gripper disclosed in DD-PS No. 67 992 is mounted by means of a clamping member on a pivotable gripper shaft having a stationary axis. A gripper tongue makes a circular movement around such axis in a first movement phase and makes a movement substantially perpendicular to the gripper support in a second movement phase. This gripper, however, uses a nonpositive parallel spring strip arrangement and a gripper tongue which cannot withstand substantial closing forces without buckling. The gripper is therefore completely unsuitable for use with very high closing forces.

Gripper systems of the type disclosed in DE-PS No. 2 030 040 utilize a perpendicularly closing gripper with a controlled gripper shaft. A disadvantage of this known system is that the nonpositive actuation of the gripper shaft relative to the fulcrum of an actuating lever is by means of a guide on a control cam. The additional components associated with the control cam lead to increased mass forces of the system. The components also oscillate with substantial radii of inertia, leading to a reduction in press performance. Also, if dirt accumulation on the cam is fairly heavy, accurate guidance of the gripper movement phases is impossible.

The gripper system shown in DE-OS No. 3 130 689 uses a soft gripper support along with a gripper finger which has a flat gripper flight path and which closes perpendicularly in the final movement phase. There is a resilient abutment screw disposed in the gripper finger and operative against the sheet gripper stop. A further adjusting screw is needed to adjust the resiliently interconnected holders by which the gripper finger is associated with the gripper shaft. A disadvantage of this type of gripper is that the gripper finger must be associated with a soft gripper support and complicated adjustment must be made by means of two adjusting screws to ensure accurate operation. Furthermore, the gripping action becomes uncertain at high press speeds.

OBJECTS AND SUMMARY OF THE INVENTION

It is a primary object of the present invention to reduce the mass and inertia radii of the components of a resilient gripper of the kind hereinbefore set out and to impart to the closing gripper finger a movement substantially perpendicular to the gripper support.

This is accomplished, according to the present invention, by a gripper having a gripping finger disposed resiliently in relation to a clamping member which is secured to a gripper shaft, the gripper finger being connected to the clamping member by a plurality of prestressed spring strips, each strip having a plurality of articulation points disposed along a line passing through the axis of the gripper shaft.

The primary advantages of the present invention are that, irrespective of the soft gripper support and without buckling or bending the gripper tip, neither disturbing forces nor vibrations can impair press performance over a wide range of speed at elevated biasings and with positive forces in the direction of sheet movement. Moreover, sheet retention is improved by a more positive gripper closing movement substantially perpendicular to the gripper support. Also, the gripper finger remains in its statically determined position and reacts less sluggishly because gripper element masses and acceleration forces are significantly reduced.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
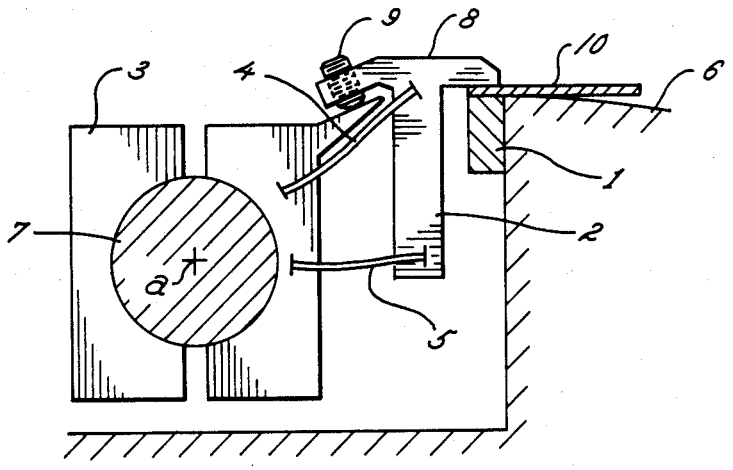
FIG. 1 is a side view of the sheet gripper of a rotary printing press according to the present invention.
Figure 2:
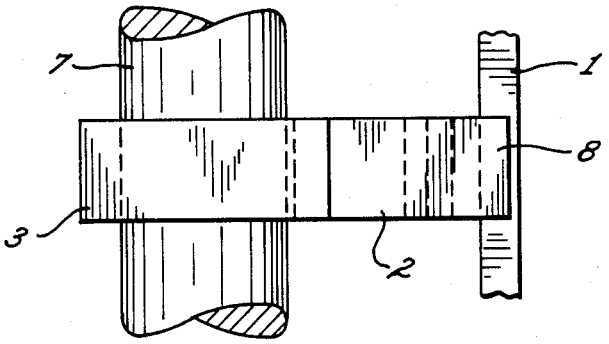
FIG. 2 is a schematic plan view of the gripper of FIG. 1.

Turning now to the drawings, FIG. 1 shows a resilient sheet gripper in which a gripper finger 2 cooperating with a gripper support 1 is resiliently connected by way of biased spring strips 4 and 5 to a clamping member 3. The clamping member 3 is secured to a gripper shaft 7 which can be disposed very low, with its axis stationary with respect to a printing press cylinder 6. As shown in FIG. 1, the gripper finger 2 is generally T-shaped in cross section with a substantially vertical stem portion.

Each spring strip 4, 5 has articulation points disposed on a connecting line which passes substantially through the stationary axis a of the gripper shaft 7. The spring strips 4, 5 press the finger 2 resiliently against a sheet 10 located on the cylinder 6 between the support 1 and a gripper tip 8 disposed on one side of the stem of the gripper finger 2. When open, the finger 2 experiences a biasing or prestressing adjustable by means of a stop screw 9 disposed on the other side of the stem which engages an ear 3*a* projecting substantially radially from the clamping member 3. It is understood that even a slight displacement of the articulation points will alter the movement of the gripper tip 8.

According to the invention, closure of the gripper 2 is accomplished by a slight S-shaped distortion of the spring strip 4 while the spring strip 5 may not be appreciably distorted. This distortion controls the motion of the finger 2 upon closure such that the motion of the finger 2 is substantially perpendicular to the support 1 thereby obviating any sliding movement between the gripper tip 8 and the support 1.

Figure 3:
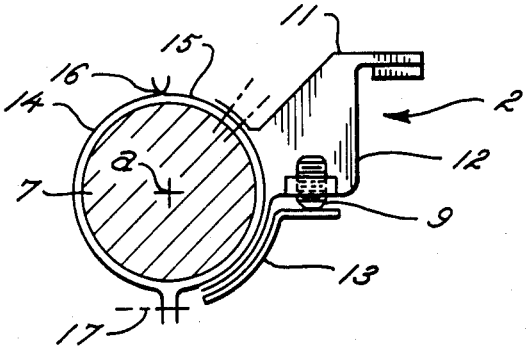
FIG. 3 is a side view similar to FIG. 1, but of an alternative sheet gripper embodiment.

An alternative sheet gripper embodiment is shown in FIG. 3, wherein the finger 2 is formed as a unitary lamination by links 11, 12 which are biased by the screw 9 and stop 13 and which are resiliently deformable. The links 11, 12 are rigidly connected to a clamping member embodied by pre-formed sheetmetal strips 14, 15 interconnecting one another at 16 and clampable on the gripper shaft 7 by means of a screw or the like at 17.

The links 11, 12 also impart a substantially perpendicular movement to the finger 2 in a movement phase which is similar to the movement produced by resilient guide elements in the form of spring strips. To accomplish this, the line of each link 11, 12, if extended, would similarly pass through the stationary axis a of the gripper shaft 7.

From the foregoing, it will be appreciated that the sheet gripper of the present invention operates to grip a sheet 10 with the final gripping motion being substantially perpendicular to the gripper support 1 so as to prevent sheet slipping. Also, the dynamic behavior of the oscillating system is improved because of the reduced mass and reduced inertia radii of the components.

We claim as our invention:

1. A resilient sheet gripper for a sheet-fed rotary printing press having a pivotable clamping member secured to a gripper shaft mounted with its axis stationary in the recess of a press cylinder, the gripper having a finger adjustably disposed and resiliently biased in relation to the clamping member, comprising, in combination, a plurality of prestressed spring strips connecting the gripper finger to the clamping member, and a plurality of articulation points along each spring strip disposed on a line passing substantially through the stationary axis of the gripper shaft.

2. A sheet gripper according to claim 1, wherein the gripper finger and the spring strips are formed as a unitary metal lamination.

3. A sheet gripper according to claim 1, wherein the clamping member includes a substantially radially extending ear, and adjusting means disposed between the gripper finger and the ear.

4. A sheet gripper according to claim 3, wherein the gripper finger has a substantially T-shaped body having a substantially vertical stem with the gripper tip disposed on one side of the stem and the adjusting means disposed on the other side of the stem.

5. A sheet gripper according to claim 4, wherein the spring strips are rigidly secured to the stem of the T-shaped gripper finger.

* * * * *